US010856087B2

(12) United States Patent
Pedersen et al.

(10) Patent No.: US 10,856,087 B2
(45) Date of Patent: Dec. 1, 2020

(54) HEARING DEVICE COMPRISING AN ACOUSTIC EVENT DETECTOR

(71) Applicant: Oticon A/S, Smørum (DK)

(72) Inventors: Michael Syskind Pedersen, Smørum (DK); Angela Josupeit, Smørum (DK); Sigurdur Sigurdsson, Smørum (DK); Anders Vinther Olsen, Smørum (DK); Nels Hede Rohde, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/448,711

(22) Filed: Jun. 21, 2019

(65) Prior Publication Data

US 2019/0394586 A1 Dec. 26, 2019

(30) Foreign Application Priority Data

Jun. 22, 2018 (EP) ..... 18179374

(51) Int. Cl.
*H04R 25/00* (2006.01)

(52) U.S. Cl.
CPC ..... *H04R 25/407* (2013.01); *H04R 25/405* (2013.01); *H04R 25/43* (2013.01);
(Continued)

(58) Field of Classification Search
CPC .. H04R 25/505; H04R 25/552; H04R 25/554; H04R 2225/41; H04R 3/005;
(Continued)

(56) References Cited

U.S. PATENT DOCUMENTS

2014/0278383 A1* 9/2014 Fan ..... G10L 25/84
704/224
2015/0172807 A1* 6/2015 Olsson ..... G10K 11/175
381/74

(Continued)

FOREIGN PATENT DOCUMENTS

EP 2 835 987 A1 2/2015
EP 3 101 919 A1 12/2016

(Continued)

OTHER PUBLICATIONS

Buechner, Andreas et al. "Advanced Beamformers for Cochlear Implant Users: Acute Measurements of Speech Perception in Challenging Listening Conditions" Apr. 22, 2014, PLOS One, Apr. 2014 vol. 9 Issue 4, all pages. (Year: 2014).*

*Primary Examiner* — Jesse A Elbin
(74) *Attorney, Agent, or Firm* — Birch, Stewart, Kolasch & Birch, LLP

(57) ABSTRACT

A hearing device, e.g. a hearing aid, comprises an input unit; an output unit; an adaptive beamformer filtering unit configured to provide a spatially filtered signal based on a multitude of electric input signals from the input unit and an adaptively updated adaptation factor β; a memory, wherein A) a reference value REF, equal to or dependent on a value, $\beta_{ov}$, of said adaptation factor β determined when a voice of the user is present, or B) a set of parameters for classification based on logistic regression or a neural network, is stored; and an own voice detector configured to provide an estimate of whether or not, or with what probability, a given input sound originates from the voice of the user, and wherein said estimate is dependent on a) a current value of said adaptation factor β and said reference value REF, or on b) said set of parameters for classification based on logistic regression or a neural network, respectively.

24 Claims, 11 Drawing Sheets

(52) U.S. Cl.
CPC ..... *H04R 25/505* (2013.01); *H04R 25/507* (2013.01); *H04R 25/554* (2013.01); *H04R 25/552* (2013.01); *H04R 2225/41* (2013.01); *H04R 2225/43* (2013.01); *H04R 2430/23* (2013.01)

(58) Field of Classification Search
CPC .... H04R 25/405; H04R 25/407; H04R 25/43; H04R 25/507; H04R 2225/43; H04R 2430/23
USPC ..... 381/313, 315, 356
See application file for complete search history.

(56) References Cited

U.S. PATENT DOCUMENTS

| | | | | |
|---|---|---|---|---|
| 2016/0205467 | A1* | 7/2016 | Elko | H04R 3/005 381/92 |
| 2017/0180878 | A1* | 6/2017 | Petersen | H04R 25/305 |
| 2017/0295437 | A1* | 10/2017 | Bertelsen | G10L 21/0232 |
| 2017/0347206 | A1* | 11/2017 | Pedersen | G10L 21/0208 |

FOREIGN PATENT DOCUMENTS

| | | | |
|---|---|---|---|
| EP | 3 236 672 | A1 | 10/2017 |
| EP | 3 253 075 | A1 | 12/2017 |
| EP | 3 328 097 | A1 | 5/2018 |

* cited by examiner

HEARING DEVICE COMPRISING AN ACOUSTIC EVENT DETECTOR

SUMMARY

The present disclosure deals with acoustic event detection in a hearing device, e.g. a hearing aid, using an estimated adaptation factor of a beamformer filtering unit. In an embodiment, the acoustic event detection comprises detection of a user's own voice. In an embodiment, the acoustic event detection comprises detection of at which of a user's ears a telephone is held. In an embodiment, the acoustic event detection comprises detection of a user's food intake.

A Hearing Device:

In an aspect of the present application, a hearing device, e.g. a hearing aid, configured to be located at or in an ear, or to be fully or partially implanted in the head at an ear, of a user, is provided. The hearing device comprising

- an input unit providing a multitude of electric input signals representing sound in an environment of the user;
- an output unit for providing stimuli perceivable to the user as sound based on said electric input signals or a processed version thereof;
- an adaptive beamformer filtering unit connected to said input unit and to said output unit, and configured to provide a spatially filtered signal based on said multitude of electric input signals and an adaptively updated adaptation factor β(k), where k is a frequency index.

The hearing device further comprises

- a memory, wherein A) a reference value REF, equal to or dependent on $\beta_{ov}(k)$ of said adaptation factor β(k) determined when a voice of the user is present is stored, or wherein B) a set of parameters for classification based on logistic regression or a neural network, is stored; and
- an own voice detector configured to estimate whether or not, or with what probability, a given input sound originates from the voice of the user, and wherein said estimate, termed the own voice indicator, is dependent on a) a current value of said adaptation factor β(k) and said reference value REF, or b) said set of parameters for classification based on logistic regression or a neural network, respectively.

Thereby an improved hearing device may be provided.

The input unit may comprise two local microphones of a hearing device or a binaural microphone configuration, e.g. one microphone at each of a left and right hearing device. An own voice (ov) decision may be based on a 'local β' (based on microphones from one hearing device) and/or a binaural β (based on microphones from both hearing devices of a binaural hearing system).

The adaptive beamformer filtering unit may comprise a first set of beamformers $C_1$ and $C_2$, wherein the adaptive beamformer filtering unit is configured to provide a resulting directional signal $Y(k)=C_1(k)-\beta(k)C_2(k)$, where β(k) is said adaptively updated adaptation factor.

The beamformers $C_1$ and $C_2$ may comprise

- a beamformer $C_1$ which is configured to leave a signal from a target direction un-altered, and
- an orthogonal beamformer $C_2$ which is configured to cancel the signal from the target direction.

In this case, the target direction is the direction of the user's mouth (the target sound source is equal to the user's own voice).

The two beamformers $C_1$ and $C_2$ may comprise

- an orthogonal beamformer $C_1$ which is configured to cancel the signal from the target direction.
- a beamformer $C_2$ which is not orthogonal to $C_1$, e.g. a front-facing cardioid.

The adaptively updated adaptation factor β(k) may be expressed as $$\beta(k) = \frac{\langle C_2^* C_1 \rangle}{\langle |C_2|^2 \rangle + c}$$

where β(k) minimizes the noise under the constraint that the signal from the target direction is unaltered, where k is the frequency index, * denotes the complex conjugation, ⟨·⟩ denotes the statistical expectation operator, and c is a constant.

The adaptively updated adaptation factor β(k) may be updated by an LMS or NLMS equation:

$$\beta(n, k) = \beta(n-1, k) + \mu \frac{C_2^* Y - \alpha\beta(n-1, k)}{|C_2|^2},$$

where α is a constant, and n and k are time and frequency indices, respectively.

The own voice indicator OV may be determined by the following expression.

$$OV = \sum_k \omega(k) \Re(\beta(k)) > TH_{ov},$$

where ω(k) is a frequency channel weighting function, ℜ(β(k) representing the real part of said adaptation factor β(k), and $TH_{ov}$ is a threshold value.

The weighting function may be given by ω(k)=1 for lower frequency channels below a first threshold frequency, and by ω(k)=0 for higher frequency channels above a second threshold frequency. In an embodiment, ω(k) at lower frequency channels ($k<k_{th}$) is higher than ω(k) at higher frequency channels ($k \geq k_{th}$). The first and second threshold frequencies may be equal. The second threshold frequency may be larger than the first threshold frequency.

The hearing device may be configured to provide that said adaptation factor β is updated in dependence of a noise flag, e.g. in dependence of a voice activity detector.

The hearing device may comprise antenna and transceiver circuitry allowing the exchange of information and/or audio signals between the hearing device and another device, e.g. an opposite hearing device of a binaural hearing system.

The own voice indicator may be dependent of an own voice estimate provided by another device, e.g. an opposite hearing device of a binaural hearing system.

The own voice indicator may be dependent of one or more other detectors, e.g. a voice activity detector, or a movement sensor, such as an accelerometer. The own voice indicator may be dependent on a level of at least one of the multitude of electric input signals.

The hearing device may be constituted by or comprise a hearing aid, a headset, an earphone, an ear protection device or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the output unit comprises a number of electrodes of a cochlear implant. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device comprises a directional microphone system (beamformer filtering unit) adapted to spatially filter sounds from the environment, and thereby enhance a target acoustic source relative to a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. In an embodiment, the wireless link is established between two devices, e.g. between an entertainment device (e.g. a TV) and the hearing device, or between two hearing devices, e.g. via a third, intermediate device (e.g. a processing device, such as a remote control device, a smartphone, etc.). In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation.

Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, all acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$ In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the number of detectors comprises a movement detector, e.g. an acceleration sensor. In an embodiment, the movement detector is configured to detect movement of the user's facial muscles and/or hones, e.g. due to speech or chewing, (e.g. jaw movement) and to provide a detector signal indicative thereof.

In an embodiment, the hearing device further comprises other relevant functionality for the application in question, e.g. compression, noise reduction, feedback reduction, etc.

In an embodiment, the hearing, device comprises a listening device, e.g. a hearing aid. e.g. a hearing instrument, e.g. a hearing instrument adapted for being, located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing aids (e.g. hearing instruments), headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device, e.g. a hearing aid, configured to be located at or in an ear, or to be fully or partially implanted in the head at an ear, of a user, is furthermore provided by the present application. The method comprises

- providing a multitude of electric input signals representing sound in an environment of the user;
- providing stimuli perceivable to the user as sound based on said electric input signals or a processed version thereof;
- providing a spatially filtered signal based on said multitude of electric input signals and an adaptively updated adaptation factor $\beta(k)$, where k is a frequency index.

The method further comprises

- storing a reference value REF equal to or dependent on said adaptation factor $\beta(k)$ determined when the voice of the user is present (or storing set of parameters for classification based on logistic regression or a neural network); and
- providing an estimate of whether or not, or with what probability, a given input sound originates from the voice of the user, wherein said estimate is dependent on a current value of said adaptation factor $\beta(k)$ and said reference value REF (or said set of parameters for classification based on logistic regression or a neural network).

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The reference value REF is e.g. equal to a reference value $\beta_{ov}(k)$ of the adaptation factor $\beta(k)$ determined when a voice of the user is present. The reference value may e.g. be determined using a model of the human head and torso (e.g. HATS from Brüel & Kjær), where the hearing device or hearing devices is/are mounted at the ears of the model and a speech generator located in the 'mouth' of the model. The reference value may e.g. advantageously be determined during a fitting session of the hearing device to the user while the user wears the hearing device(s) and uses his or her own voice as sound source. Alternatively (or additionally), it may be determined in a specific training session while wearing the hearing device (or hearing system). The training session may e.g. be initiated via a user interface of a remote control (e.g. implemented as an APP, e.g. on a smartphone). Preferably, an environment noise level is relatively low during determination of the reference value REF.

Supervised Learning.

A user's own voice may be classified by supervised learning techniques in the form of logistic regression, or in the form of a neural network (see e.g. FIG. 10A, 10B).

In an embodiment, the user's own voice is classified by a neural network, e.g. a deep neural network.

In an embodiment, the input to the neural network is given by the parameter (e.g. vector) β. In another embodiment, the input vector is a subset of β, such as the values of β corresponding to frequencies below a certain threshold frequency $f_{th}$. This may be advantageous as the values of β at low frequencies bands are less user-dependent and less sensitive to obstacles near the ear. The threshold frequency $f_{th}$, may e.g. be 500 Hz, 750 Hz or 1000 Hz.

In yet another embodiment, the input vector to the network may contain additional features besides β. Such features may e.g. be a) accelerometer data, b) a β-vector from another hearing device (β may be exchanged between the hearing devices at respective ears), c) Mel Frequency Cepstral Coefficients (MFCC), or d) features derived thereof, such as e.g. user specific features like pitch.

In another embodiment, different OV detectors may be implemented for different applications. For the same set of input vectors, different neural networks may be trained for different applications, wherein the training data may be (fully or partly different), e.g. an OV detector for key word spotting, another OV detector for user identification, a third OV detector used to control a microphone matching system, and yet another OV detector used in connection with phone conversations (wherein an additional feature may be whether the far-end is talking).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising, a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing, device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

The 'near-field' of an acoustic source is a region close to the source where the sound pressure and acoustic particle velocity are not in phase (wave fronts are not parallel). In the near-field, acoustic intensity can vary greatly with distance (compared to the far-field). The near-field is generally taken to be limited to a distance from the source equal to about one or two wavelengths of sound. The wavelength λ of sound is given by $\lambda = c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs. e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids or binaural hearing aid systems.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
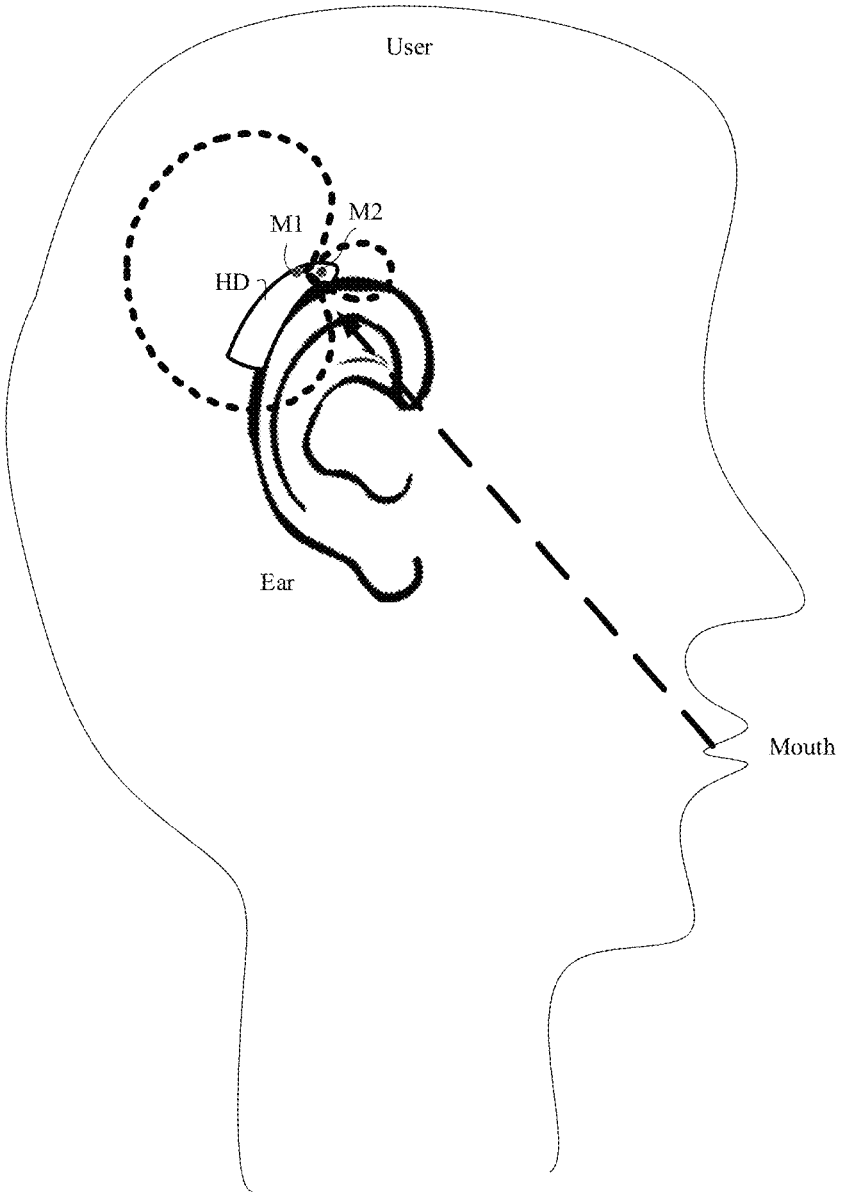
FIG. 1 schematically shows a situation where the person wearing a hearing device is talking, and where the adaptive beamformer will adapt its beampattern in order to cancel the person's own voice.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Directionality by beamforming in hearing aids is an efficient way to attenuate unwanted noise as a direction-dependent gain can cancel noise from one direction while preserving the sound of interest impinging from another direction hereby potentially improving the speech intelligibility. Typically, beamformers in hearing instruments have beampatterns, which continuously are adapted in order to minimize the noise while sound impinging from the target direction is unaltered. As the acoustic properties of the noise signal changes over time, the beam former is implemented as an adaptive system, which adapts the directional beampattern in order to minimize the noise while the target sound (direction) is unaltered. Some acoustic events have distinct directional beampatterns, which can be distinguished from other acoustic events. A hearing instrument user's own voice is an example of such an event. This is illustrated in FIG. 1, where the beampattern has been adapted towards cancelling, the user's own voice.

FIG. 1 shows a situation where the person wearing a hearing device is talking, and where the adaptive beam former will adapt its beampattern in order to cancel the person's own voice. As the own voice is in the near-field, the obtained beampattern which is optimal for own-voice cancellation will typically be different from beampatterns optimal for far field sound sources.

Figure 4:
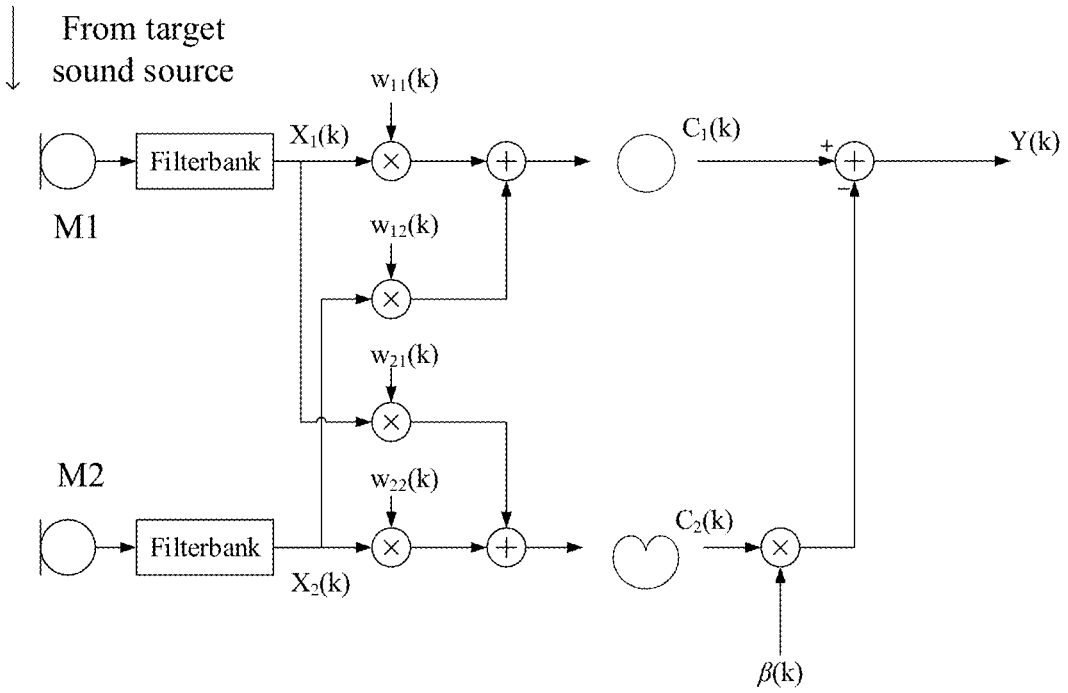
FIG. 4 shows an adaptive beamformer configuration, wherein the adaptive beamformer in the k'th frequency channel Y(k) is created by subtracting a target cancelling beamformer scaled by the adaptation factor β(k) from an omnidirectional beamformer.
Figure 5:
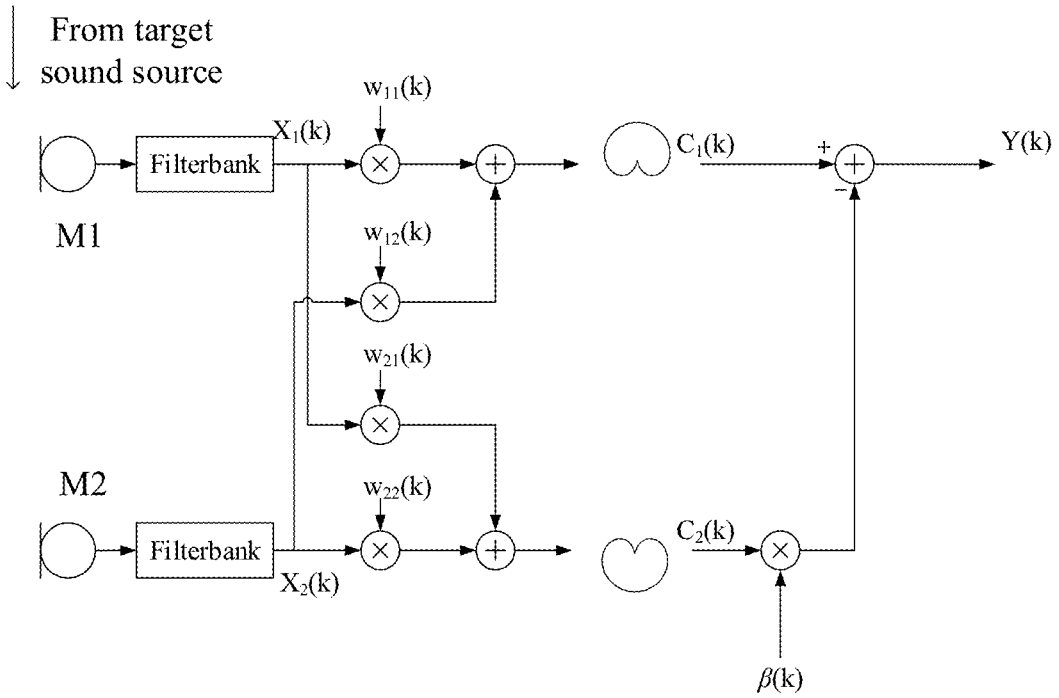
FIG. 5 shows an adaptive beamformer configuration similar to the one shown in FIG. 4, where the adaptive beampattern Y(k) is created by subtracting a target cancelling beamformer C2(*k*) scaled by the adaptation factor β(k) from another fixed beampattern C1(*k*), FIG. 6A schematically shows a first telephone conversation scenario where own voice is presented to both hearing instruments.

We propose a two-microphone beamformer configuration as shown in FIG. 4 or FIG. 5. An adaptive beampattern (Y(k)), for a given frequency band k, is obtained by linearly combining two beamformers $C_1(k)$ and $C_2(k)$. $C_1(k)$ and $C_2(k)$ are different (possibly fixed) linear combinations of the microphone signals.

FIG. 4 shows an adaptive beamformer configuration, wherein the adaptive beamformer in the k'th frequency channel Y(k) is created by subtracting a target cancelling beamformer scaled by the adaptation factor β(k) from an omnidirectional beamformer. The two beamformers $C_1$ and $C_2$ of FIG. 4 are e.g. orthogonal. This is actually not necessarily the case, though. The beamformers of FIG. 5 are not orthogonal. When the beamformers $C_1$ and $C_2$ are orthogonal, uncorrelated noise will be attenuated when β=0.

Whereas $C_1(k)$ in FIG. 4 was an omnidirectional beampattern, the beampattern in FIG. 5 is a beamformer with a null towards the opposite direction of that of $C_2(k)$. Other sets of fixed beampatterns $C_1(k)$ and $C_2(k)$ may as well be used.

FIG. 5 shows an adaptive beamformer configuration similar to the one shown in FIG. 4, where the adaptive beampattern Y(k) is created by subtracting a target cancelling beamformer C2(*k*) scaled by the adaptation factor β(k) from another fixed beampattern C1(*k*). This set of beamformers are not orthogonal. In case that $C_1$ in FIG. 5 is an OV cancelling beamformer, β will be close to zero, when own voice is present, and there is no need for a calibrated own voice β.

The beampatterns could e.g. be the combination of an omnidirectional delay-and-sum-beamformer $C_1(k)$ and a delay-and-subtract-beamformer $C_2(k)$ with its null direction pointing towards the target direction (target cancelling beamformer) as shown in FIG. 4 or it could be two delay-and-subtract-beamformers as shown in FIG. 5, where the one $C_1(k)$ has maximum gain towards the target direction, and the other beam former is a target cancelling beamformer. Other combinations of beamformers may as well be applied. Preferably, the beamformers should be orthogonal, i.e. $[w_{11}\ w_{12}][w_{21}\ w_{22}]^H=0$. The adaptive beampattern arises by scaling the target cancelling beamformer $C_2(k)$ by a complex-valued, frequency-dependent, adaptive scaling factor β(k) and subtracting it from the $C_1(k)$, i.e.

$$Y(k) = C_1(k) - \beta(k)C_2(k) = w_1^H(k)x(k) - \beta(k)w_2^H(k)x(k).$$

Where $w_1^H=[w_{11}, w_{12}]$, $w_2^H=[w_{21}, w_{22}]$ are complex beamformer weights according to FIG. 4 or FIG. 5 and $x=[x_1,x_2]^T$ is the input signals at the two microphones (after filter bank processing).

The beamformer is adapted to work optimally in situations where the microphone signals consist of a point-noise target sound source in the presence of additive noise sources. Given this situation, the scaling factor β(k) is adapted to minimize the noise under the constraint that the sound impinging from the target direction is unchanged. For each frequency band k, the adaptation factor β(k) can be found in different ways. The solution may be found in closed form as $$\beta(k) = \frac{\langle C_2^* C_1 \rangle}{\langle |C_2|^2 \rangle + c}, \tag{1}$$

where * denote the complex conjugation and ⟨·⟩ denotes the statistical expectation operator, which may be approximated in an implementation as a time average. c is a small constant in order to avoid dividing by zero. As an alternative, the adaptation factor may be updated by an LMS or NLMS equation:

$$\beta(n,k) = \beta(n-1,k) + \mu\frac{C_2^* Y - \alpha\beta(n-1,k)}{|C_2|^2},$$

where α is a constant. In an embodiment, α=1, and μ is a step size of the algorithm. It should be noted that β is NOT independent of $C_1$ (depends on $C_1$ via the recursive update of β, $Y=C_1-\beta C_2$).

For a given frequency band k, each value of β(k) will provide a specific beampattern able to cancel sound from a certain position (see e.g. EP3236672A1). The optimal value of β(k) will depend on the acoustic properties of the head, the position of the hearing instrument, and the position of the sound source (direction and distance). Most sounds will origin far from the hearing instruments, which means that the sound pressure at the hearing instrument microphones will be similar. As the distance from mouth to microphones is small, own voice will be in the near field and potentially, the sound pressure at the hearing instrument microphones will be substantially different (compared to the case for a signal from the acoustic far-field). β(k) is dependent on the sound pressure amplitude at the front and rear microphone, $a_1$ and $a_2$ in the following way (for orthogonal beam former weights):

$$\beta = \frac{a_1^2\alpha - a_2^2\alpha - a_1a_2(1-\alpha^2)\cos(A)}{a_1^2\alpha^3 + a_2^2\alpha - 2a_1a_2\alpha^2\cos(A)} + i\frac{a_1a_2(1+a^2)\sin(A)}{a_1^2\alpha^3 + a_2^2\alpha - 2a_1a_2\alpha^2\cos(A)} \text{ with } A = \frac{2\pi fd}{c}(\cos\theta_0 - \cos\theta).$$

where α is the amplitude ratio of the rear microphone compared to the front microphone of the calibration sound (i.e. predetermined), f is the frequency, d is the distance between the microphones, c is the sound velocity, $\theta_0$ is the direction of the look vector and θ is the direction of the sound source.

In the following, we set α=1, because we assume calibration with a far-field signal, so that the amplitude difference can be neglected. This reduces the real part of β to $$\Re(\beta) = \frac{a_1^2 - a_2^2}{a_1^2 + a_2^2 - 2a_1a_2\cos(A)} = \frac{r^2 - 1}{r^2 + 1 - 2r\cos(A)},$$

with $r=a_1/a_2$.

The direction of the look vector is $\theta_0=0°$. We assume that the own voice signal is coming from θ=45° relative to the horizontal plane, see FIG. 2.

Figure 2:
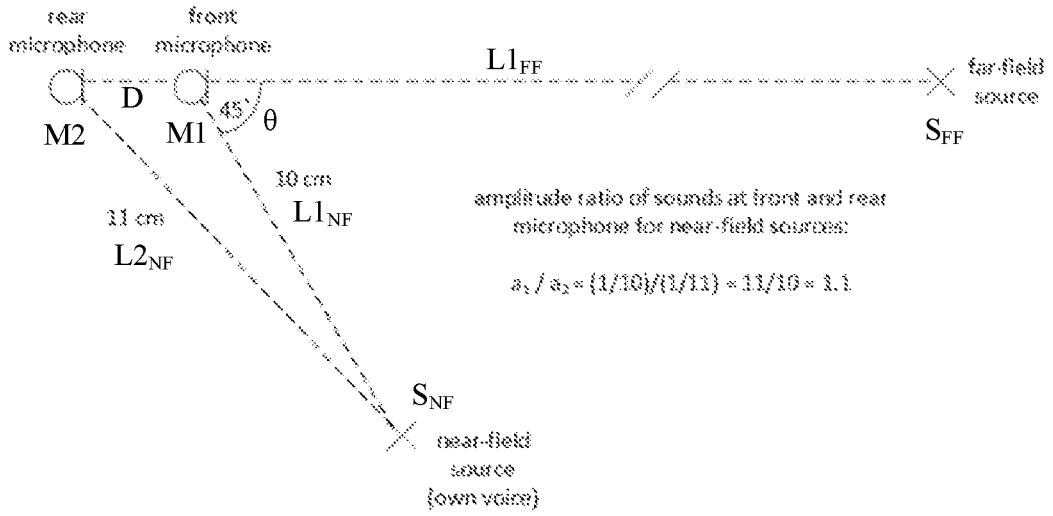
FIG. 2 shows an exemplary illustration of the geometry of a near-field sound source, here own voice.

FIG. 2 shows an exemplary illustration of the geometry of a near-field sound source, here own voice ($S_{NF}$). A distinction between an acoustic near-field and far-field is related to the frequency (wavelength) of the sound and can be taken to lie around 2 wavelengths λ, i.e. for distances<2λ from the sound source, the near-field prevail, and for distances>2λ, from the sound source, the far-field prevail. The sound pressure from a sound source is attenuated with increasing distance L from the sound source. For a far-field sound source $S_{FF}$, (located e.g. >1 m away from a measurement location, e.g. a microphone), the sound pressure is decreased 6 dB for every doubling of the distance to the sound source. For a near-field sound source it is more complicated (variable). The difference in distance from the near field source $S_{NF}$ to the first and second microphones (M2, M1), here $\Delta L_{NF}=L2_{NF}-L1_{NF}$ is assumed to be equal to 10 mm. The angle θ between the microphone axis (here pointing towards the far-field sound source $S_{FF}$) and the direction from the near-field sound source ($S_{NF}$) to the first microphone is assumed to be 45°. The difference is the same for the far-field source $S_{FF}$. The ratio of the difference to the smallest distance ($\Delta L_{NF}/L1_{NF}$) for the near-field source ($S_{NF}$) is, however, much larger than the corresponding ratio ($\Delta L_{NF}/L1_{NF}$) for the far field source ($S_{NF}$), since $L1_{FF}>>L1_{NF}$. If an inverse scaling of sound pressure amplitude is assumed in the near-field, the ratio of the amplitudes ($a_1$, $a_2$) from the near-field sound source ($S_{NF}$) at the microphones (M1, M2) is given by $$\frac{a_1}{a_2} = \frac{\left(\frac{1}{10}\right)}{\left(\frac{1}{11}\right)} = 1.1$$

This indicates that the difference in sound pressure from the near-field sound source at the First and second microphones (M1, M2) can be much larger than the difference in sound pressure from the far-field sound source. Angles and distances are approximated.

Figure 3:
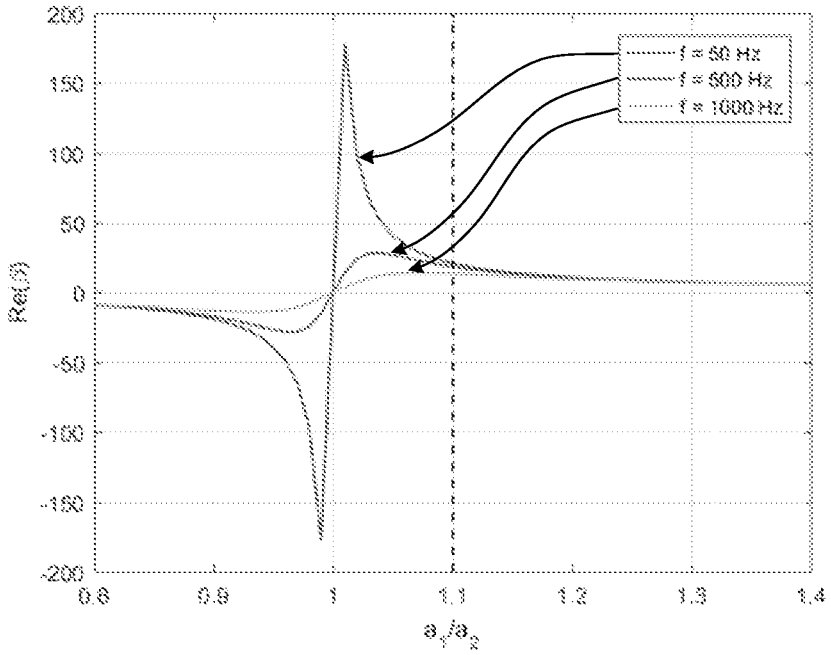
FIG. 3 shows an analytical solution for the real part of β as a function of the amplitude ratio of the front and rear microphone signal, when α=1.

Using d=13 mm and c=340 m/s, we get the relationship of $\Re(\beta)$ depending on r as shown in FIG. 3.

FIG. 3 shows an analytical solution for the real part of β as a function of the amplitude ratio of the front and rear microphone signal, when α=1. FIG. 3 illustrates that around the assumed amplitude ratio of r=1.1 the real part of β becomes quite large, i.e., around 20 for lower frequencies. The large difference is due to the fact that the magnitude response of the two orthogonal beamformers (i.e. a delay-sum and a delay-subtract beamformer) at very low frequencies becomes very different in the case, where the target cancelling beamformer cancels the input signal ($a_1/a_2=1$). In the case where the input signal is not cancelled, the difference between the two orthogonal beamformers is smaller. What is important is that the real part, even for higher frequencies, becomes different from zero, when $a_1$ is not equal to $a_2$.

We thus propose an own voice detector based on this characteristic.

$$OV = \sum_k \omega(k)\Re(\beta(k)) > TH_{ov}, \tag{2}$$

where ω(k) is a frequency channel weighting function and $TH_{ov}$ is a threshold. Setting ω(k)=1 for lower frequency channels and ω(k)=0 for higher frequency channels might be an advantage, because (1) $\Re(\beta)$ has higher values for lower frequencies in the assumed amplitude ratio range and (2) lower frequencies are more robust to variations in beam former weights between end users. In an embodiment, own voice is only detected at low frequencies as the low frequency behaviour corresponds well to the equations derived under the free field assumption, e.g. <2 kHz, or <1.5 kHz.

The averaging across frequency could lead to an incorrectly detected own voice. It would be an advantage to use a level dependent OV detection as most own voice is above a certain level.

Introducing a level detector may as well help coping with another issue, namely false OV detection clue to mismatched microphones.

A level difference between microphones will be present at all input levels, where OV is only present at high input levels. We may thus choose only to adapt microphone level differences, when own voice is not detected. And by introducing a level detector in the own voice detection, we may still allow the microphone matching to adapt at low input levels, such as input levels below 50 dB or below 55 dB.

Several own voice decisions may be running in parallel, possibly with different criteria for own voice detection, depending on the application (key word spotting, microphone matching etc.).

Alternatively, own voice detection may be based on the following characteristic.

$$OV = \sum_k \omega(k)(\Re(\beta(k)) > \tau(k)) > TH_{ov}, \text{ or on}$$

$$OV = \sum_k \omega(k)((|(\beta(k) - \beta_{ov}(k)|) > \tau(k)) > TH_{ov},$$

Where τ(k) is a frequency-dependent threshold. The threshold values may depend on the intended use of the OV detector. In an embodiment, different OV thresholds may be used in parallel for different applications of the OV detector.

The own voice detection can be made more robust by combining the detector of the left and right hearing instrument. The detector may be combined with other detectors, such as a voice activity detector, or a built-in accelerometer, or input level.

Presenting the output sound from an adaptive beamformer adapting towards the user's own voice beamformer should typically be avoided as it becomes difficult for the user to determine his own voice level. An own voice detector may thus be used to prevent the beamformer from cancelling the user's own voice. E.g. by fading out the adaptive beamformer as described in EP3236672A1.

If own voice is detected, the update of the microphone matching algorithm should be paused, as a microphone matching algorithm is likely to adapt to the microphone level difference caused by own voice.

Figure 6A:
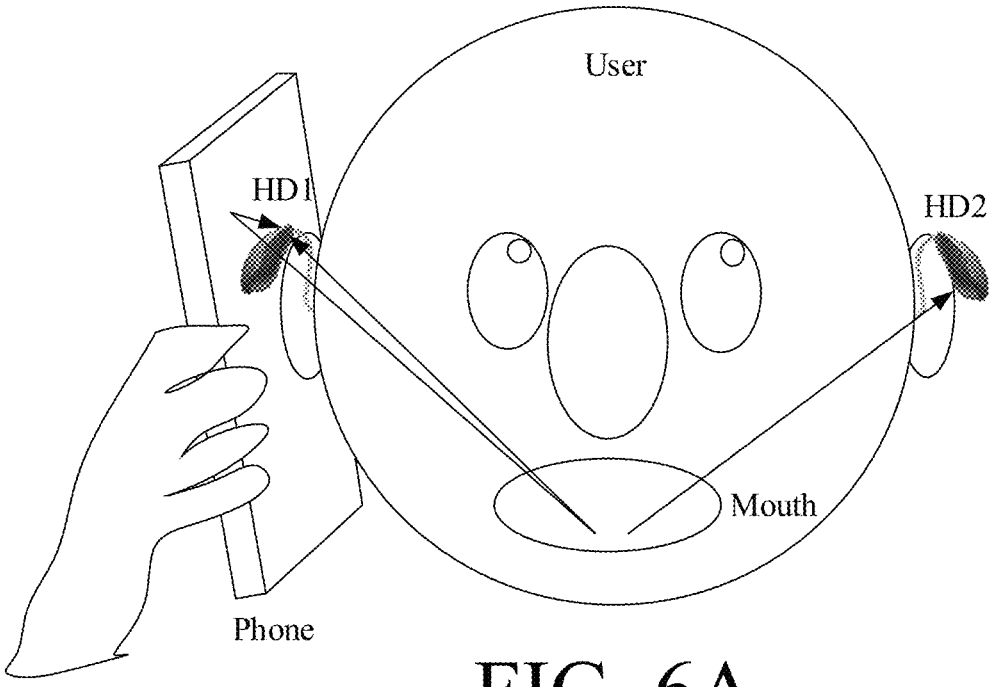
FIG. 6B shows a second part of a telephone conversation scenario where a near field sound from the loudspeaker of the telephone is presented to the hearing instrument to which the instrument is kept, when far-end sound is present.
Figure 6B:
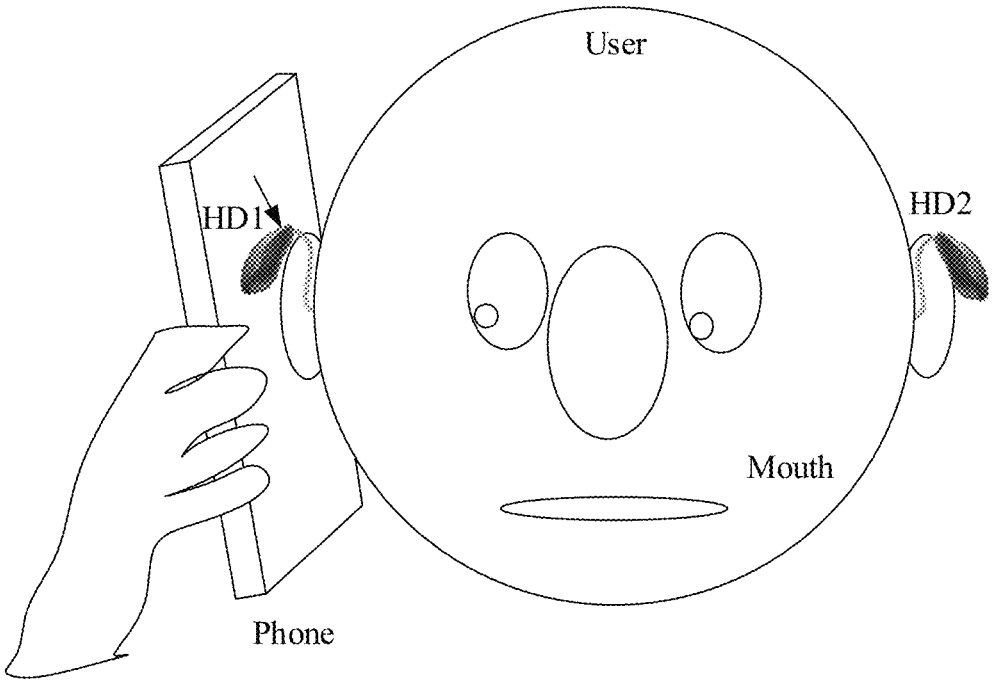

Another near field sound is sound from the telephone which is held close to the ear. This is illustrated in FIG. 6A, 6B. FIG. 6A shows a first telephone conversation scenario where own voice is presented to both hearing instruments. FIG. 6B shows a second part of a telephone conversation scenario where a near field sound from the loudspeaker of the telephone is presented to the hearing instrument to which the instrument is kept, when far-end sound is present. This can be used to detect a phone conversation and to which instrument the telephone is kept.

When the user wearing the hearing instrument is talking, it is expected that the own voice detector works best at the ear far from the telephone (i.e. at HD2 located at the right ear in FIG. 6A) as reflections from the telephone (Phone) may disturb the own voice beamformer adaptation coefficient. This difference may be used to determine at which ear the telephone is kept. As well as own voice may correspond to a distinct value of β, a phone near the ear may correspond to a distinct value of β.

Alternatively or in addition, knowing that the far-end sound from the telephone is band-limited and presented in the near field can also create a unique telephone beamformer fingerprint which can be used to determine if a telephone conversation is carried out:

$$PhoneDetect = \sum_k \omega(k)\|\beta(k) - \beta_{phone}(k)\| < TH_{phone}$$

where $TH_{phone}$ is a threshold value. Knowing that a phone conversation is carried out and at which ear, the phone is kept, could be used to enable transmission of the telephone signal from the hearing instrument receiving the telephone signal to the opposite hearing instrument. Also in this case, other classification schemes may be applied (e.g. logistic regression or neural networks).

Figure 7:
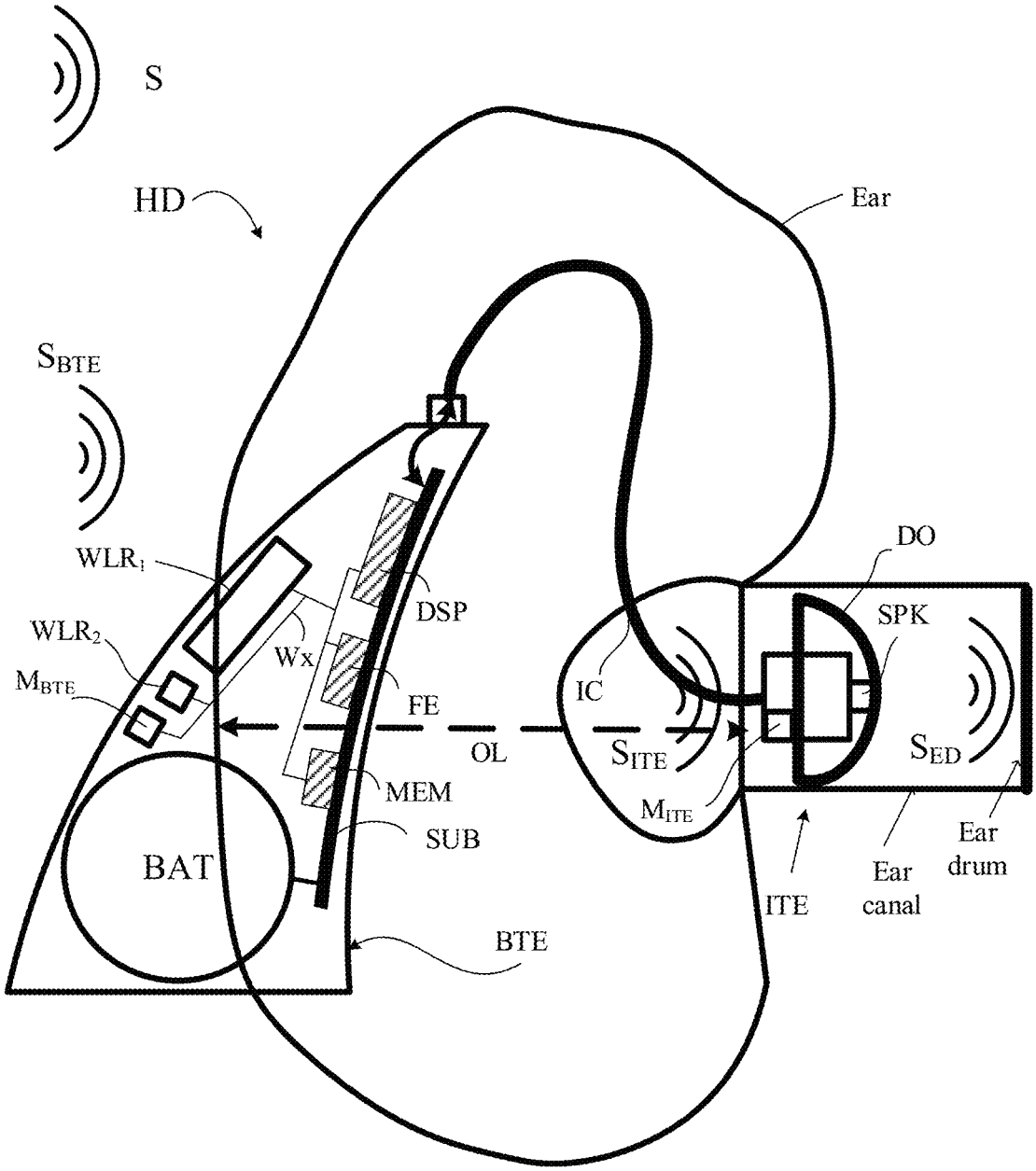
FIG. 7 shows an embodiment of a hearing device according to the present disclosure comprising microphones located in a BTE-part as well as in an ITE-part.

FIG. 7 shows an embodiment of a hearing device according to the present disclosure comprising microphones located in a BTE-part as well as in an ITE-part. The hearing device (HD) of FIG. 7. e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising an output transducer (SPK), e.g. a receiver (loudspeaker). The BTE-part and the ITE-part are connected (e.g. electrically connected) by a connecting element (IC) and internal wiring in the ITE- and BTE-parts (cf. e.g. schematically illustrated as wiring Wx in the BTE-part). The BTE- and ITE-parts each comprise an input transducer, e.g. a microphone ($M_{BTE}$ and $M_{ITE}$), respectively, which are used to pick up sounds from the environment of a user wearing the hearing device. In an embodiment, the ITE-part is relatively open allowing air to pass through and/or around it thereby minimizing the occlusion effect perceived by the user. In an embodiment, the ITE-part according to the present disclosure is less open than a typical RITE-style comprising only a loudspeaker (SPK) and a dome (DO) to position the loudspeaker in the ear canal (cf. FIG. 4C). In an embodiment, the ITE-part according to the present disclosure comprises a mould and is intended to allow a relatively large sound pressure level to be delivered to the ear drum of the user (e.g. a user having a severe-to-profound hearing loss). In an embodiment, the loudspeaker is located in the BTE-part and the connecting element (IC) comprises a tube for acoustically propagating sound to an ear mould and though the ear mould to the eardrum of the user. In an embodiment the vent size can be altered (e.g. mechanically, or electrically) depending on an OV detector. An electrically controllable vent is e.g. described in EP2835987A1.

The hearing device (HD) comprises an input unit comprising two or more input transducers (e.g. microphones) (each for providing an electric input audio signal representative of an input sound signal). The input unit further comprises two (e.g. individually selectable) wireless receivers ($WLR_1$, $WLR_2$) for providing respective directly received auxiliary audio input and/or control or information signals. The BTE-part comprises a substrate SUB whereon a number of electronic components (MEM, FE, DSP) are mounted. The BTE-part comprises a configurable signal processor (DSP) and memory (MEM) accessible therefrom. In an embodiment, the signal processor (DSP) form part of an integrated circuit, e.g. a (mainly) digital integrated circuit, whereas the front-end chip (FE) comprises mainly analogue circuitry and/or mixed analogue digital circuitry (including interfaces to microphones and loudspeaker).

The hearing device (HD) comprises an output transducer (SPK) providing an enhanced output signal as stimuli perceivable by the user as sound based on an enhanced audio signal from the signal processor (DSP) or a signal derived therefrom. Alternatively or additionally, the enhanced audio signal from the signal processor (DSP) may be further processed and/or transmitted to another device depending on the specific application scenario.

In the embodiment of a hearing device in FIG. 7, the ITE part comprises the output unit in the form of a loudspeaker (receiver) (SPK) for converting an electric signal to an acoustic signal. The ITE-part of the embodiments of FIG. 7 also comprises input transducer ($M_{ITE}$, e.g. a microphone) for picking up a sound from the environment. The input transducer ($M_{ITE}$) may—depending on the acoustic environment—pick up more or less sound from the output transducer (SPK) (unintentional acoustic feedback). The ITE-part further comprises a guiding element. e.g. a dome or mould or micro-mould (DO) for guiding and positioning the ITE-part in the ear canal (Ear canal) of the user.

In the scenario of FIG. 7, a (far-field) (target) sound source S is propagated (and mixed with other sounds of the environment) to respective sound fields at the BTE microphone ($M_{BTE}$) of the BTE-part $S_{ITE}$ at the ITE microphone ($M_{ITE}$) of the ITE-part, and $S_{ED}$ at the ear drum (Ear drum)

The hearing devices (HD) exemplified in FIG. 7 represent a portable device and further comprises a battery (BAT), e.g. a rechargeable battery, for energizing electronic components of the BTE- and ITE-parts. The hearing device of FIG. 7 may in various embodiments implement an own voice detector according to the present disclosure.

In an embodiment, the hearing device (HD), e.g. a hearing aid (e.g. the processor (DSP)), is adapted to provide a frequency dependent gain and/or a level dependent compression and/or a transposition (with or without frequency compression) of one or frequency ranges to one or more other frequency ranges, e.g. to compensate for a hearing impairment of a user.

The hearing device of FIG. 7 contains two input transducers ($M_{BTE}$ and $M_{ITE}$), e.g. microphones, one ($M_{ITE}$, in the ITE-part) is located in or at the ear canal of a user and the other ($M_{BTE}$, in the BTE-part) is located elsewhere at the ear of the user (e.g. behind the ear (pinna) of the user), when the hearing device is operationally mounted on the head of the user. In the embodiment of FIG. 7, the hearing device is configured to provide that the two input transducers ($M_{BTE}$ and $M_{ITE}$) are located along a substantially horizontal line (OL) when the hearing device is mounted at the ear of the user in a normal, operational state (cf. e.g. input transducers $M_{BTE}$, $M_{ITE}$ and double arrowed, dashed line OL in FIG. 7). This has the advantage of facilitating beamforming of the electric input signals from the input transducers in an appropriate (horizontal) direction, e.g. in the 'look direction' of the user (e.g. towards a target sound source).

Figure 8A:
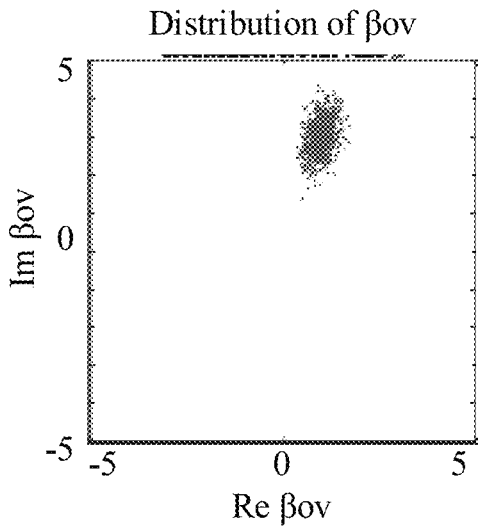
FIG. 8A shows an exemplary distribution of samples of β labelled "own voice"
Figure 8B:
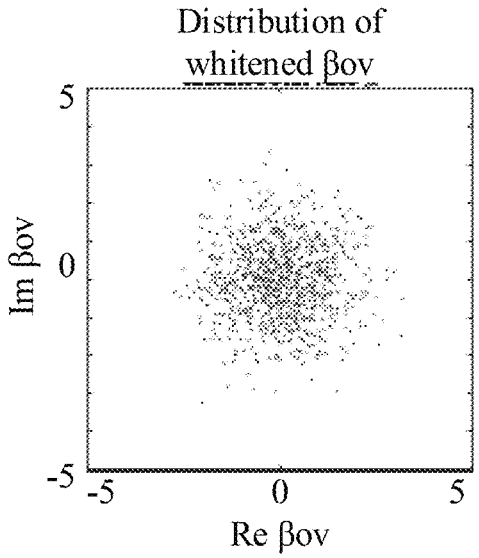
FIG. 8B shows a whitened version of the 'own voice β' of FIG. 8A, such that the data are centered on the origin and having unit variance.

FIG. 8A shows an exemplary distribution of samples of β labelled "own voice". FIG. 8B shows a whitened version of the 'own voice β' of FIG. 8A, such that the data are centered on the origin and having unit variance. Hereby the likelihood of own voice based on the size of β can easily be assessed.

In order to apply a simple criterion for labelling own voice based on the size of β, we can pre-whiten the data. The pre-whitening is e.g. applied by subtracting the mean of the dataset and applying a rotation and scaling matrix (e.g. based on the Cholesky factorization), such that the data labelled "voice" is a distribution with zero mean and unit variance. Hereby we can apply a simple criterion where a given sample of beta is labelled own voice (e.g. the own voice indicator), if the size of β (based on a distance measure, e.g. based on an Euclidian distance) is smaller than a given threshold.

Figure 9A:
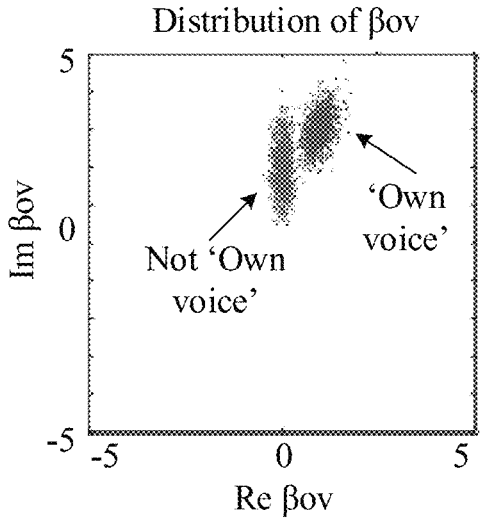
FIG. 9A illustrates the exemplary distribution of samples of β labelled "own voice" as shown in FIG. 8A together with the distribution of samples of β NOT labelled "own voice"
Figure 9B:
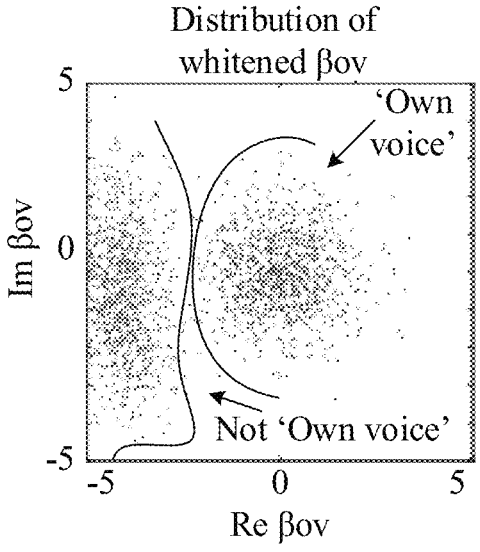
FIG. 9B illustrates the effect of a whitening of the data of FIG. 9A, FIG. 10A schematically illustrates an example classifying own voice by supervised learning techniques in the form of logistic regression, and FIG. 10B s schematically illustrates an example classifying own voice by supervised learning techniques in the form of a neural network.

FIG. 9A illustrates a whitening applied to the part of the full dataset of data labelled 'own voice' as shown in FIG. 8A (blue). FIG. 9B illustrates a whitening applied to the part of the full dataset of data labelled 'not own voice' (red).

Example: Supervised Learning

Figure 10A:
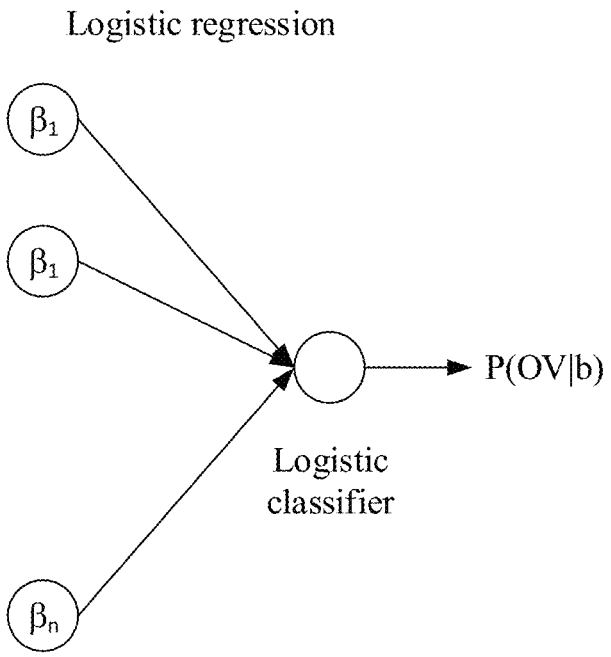
Figure 10B:
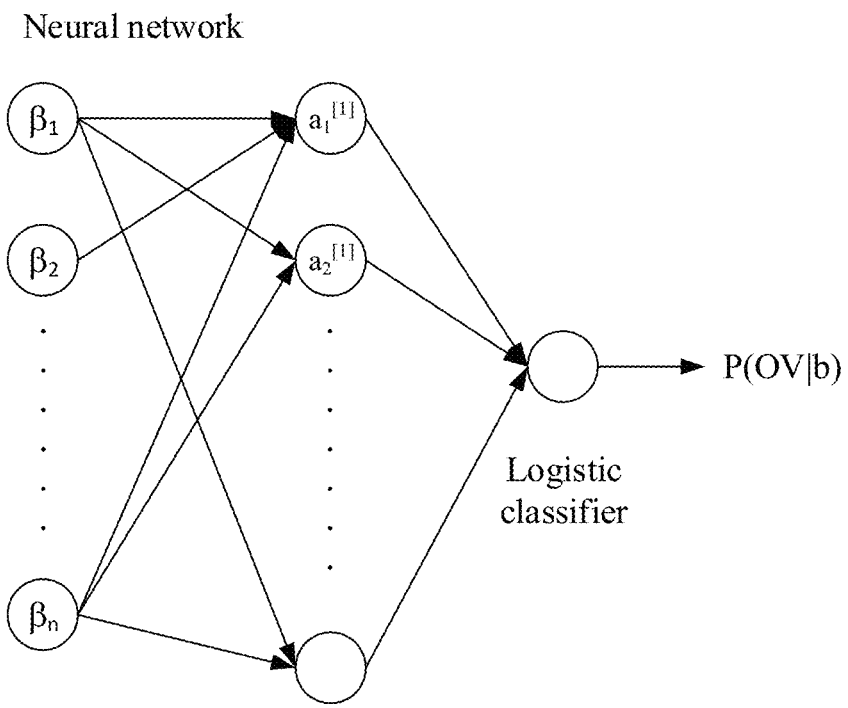

FIG. 10A schematically illustrates an example classifying own voice by supervised learning techniques in the form of logistic regression. FIG. 10B s schematically illustrates an example classifying own voice by supervised learning techniques in the form of a neural network.

Own voice may as well be classified based on supervised learning, i.e. given a set of n sampled values of $\beta[\beta_1, \ldots, \beta_n]$ labelled by own voice/no own voice. The own voice may e.g. be detected by logistic regression or by an L-hidden layer neural network (here a feed-forward network shown for L=1). Besides β, other sensor data may be provided as input too (e.g. acceleration data and/or input level and/or β values communicated from the other instrument of a binaural hearing system). The feed-forward network is shown here as an example. Other network structures (e.g. convolutive networks or recurrent networks) or combinations of different network structures may as well be applied.

The logistic classifier typically consists of a sigmoid function $$\sigma(z) = \frac{1}{1 + e^{-z}}$$

applied to the linear function z=Wx+b where W is an 1×n weight vector multiplied to the n×1 input vector x (=β). b is a scalar bias. The logistic function maps the scalar value z into a probability value between 0 and 1, which can be converted into a binary decision by applying a threshold. The values of W and b are optimized based on labelled training data (e.g. containing own voice/not own voice).

Similar to the logistic regression, a neural network (exemplified in FIG. 10B as a feed-forward neural network) has an input layer, and an output layer, which again could be given by a logistic function applied to z. Furthermore, the neural network has one or more hidden layers. In an embodiment, the neural network contains three layers. A hidden layer l contains a number $n^{[l]}$ of neurons, each passing information from the previous layer the next layer. The ith neuron of the lth layer $a_i^{[l]}$ applies a nonlinear activation function g(z) to the data from the previous layer. In vector notation, i.e. $a^{[l]}=g(W^{[l]}a^{[l-1]}+b^{[l]})$ where $a^{[l]}=[a_1^{[l]} \ldots a_{n^{[l]}}^{[l]}]^T$, $W^{[l]}$ is a weight matrix for the lth layer of size $n^{[l]}\times n^{[l-1]}$, and $b^{[l]}$ is a bias vector of size $n^{[l]}\times 1$. Similar to the case of logistic regression, the values of $W^{[l]}$ and $b^{[l]}$ are optimized based on labelled training data (e.g. containing own voice/not own voice).

In an embodiment, the input to the neural network is given by the parameter (e.g. vector) β. In another embodiment, the input vector is a subset of β, such as the values of β corresponding to frequencies below a certain threshold frequency $f_{th}$. This may be advantageous as the values of β at low frequencies bands are less user-dependent and less sensitive to obstacles near the ear. The threshold frequency $f_{th}$ may e.g. be 500 Hz, 750 Hz or 1000 Hz.

In yet another embodiment, the input vector to the network may contain additional features besides β. Such features may e.g. be a) accelerometer data, b) a β-vector from another hearing device (β may be exchanged between the hearing devices at respective ears), c) Mel Frequency Cepstral Coefficients (MFCC), or d) features derived thereof, such as e.g. user specific features like pitch.

In another embodiment, different OV detectors may be implemented for different applications. For the same set of input vectors, different neural networks may be trained for different applications, wherein the training data may be (fully or partly different), e.g. an OV detector for key word spotting, another OV detector for user identification, a third OV detector used to control a microphone matching system, and yet another OV detector used in connection with phone conversations (wherein an additional feature may be whether the far-end is talking).

Figure 13A:
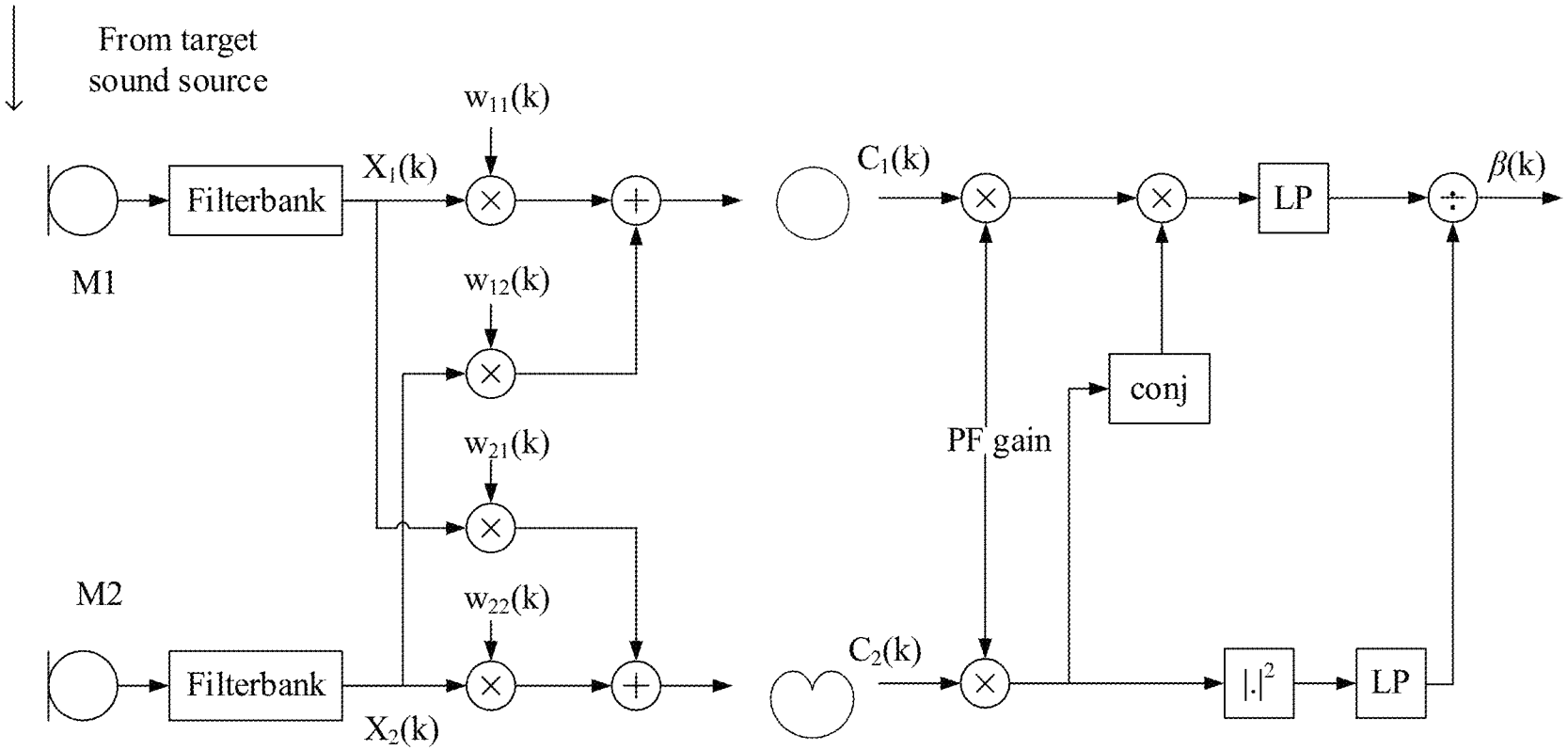
FIG. 13A shows an adaptive beamformer configuration, wherein post filter gains are applied to an omnidirectional beamformer and a target cancelling beamformer, respectively, and based smoothed versions thereof, the adaptation factor β(k) is determined.

FIG. 13A shows an adaptive beamformer configuration, wherein post filter gains (PF gain) are applied to an omnidirectional beamformer ($C_1(k)$) and a target cancelling beamformer ($C_2(k)$), respectively, and based on possibly smoothed versions thereof, the adaptation factor β(k) is determined.

Before β(k) is estimated, post filter gains (PF gain) (varying across time and frequency) may be applied to each of the microphone signals. Either directly to the time-frequency representation of microphone signals $X_1(k)$, $X_2(k)$ or to the derived beamformers $C_1(k)$ and $C_2(k)$ (defined by respective sets of complex beamformer weights ($w_{11}(k)$, $w_{12}(k)$) and ($w_{21}(k)$, $w_{22}(k)$)), e.g. as illustrated in FIG. 13A to an omnidirectional beamformer ($C_1(k)$) and a target cancelling beamformer ($C_2(k)$), respectively. As the aim of the post filter is to attenuate background noise while keeping the target signal (e.g. own voice, see FIG. 13B) unaltered, it is possible to remove some noise before calculating β(k). This is advantageous as the background noise may influence β(k). LP is an (optional) low-pass filtering (smoothing) unit. The unit (Conj) provides a complex conjugate of the input signal to the unit. The unit $|\cdot|^2$ provides a magnitude squared of the input signal to the unit.

Figure 13B:
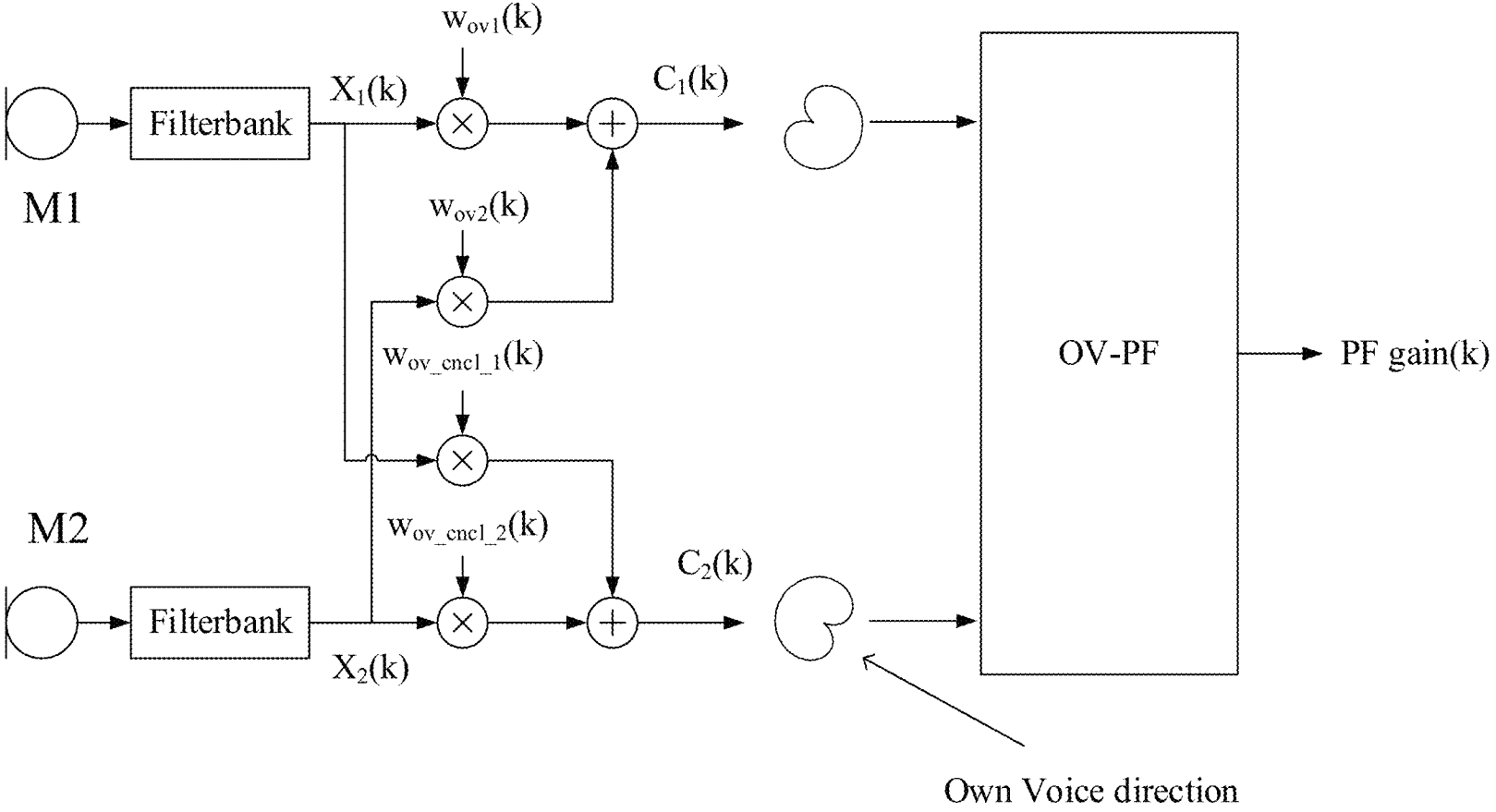
FIG. 13B shows an own voice beamformer configuration illustrating how the own voice-enhancing post filter gain may be estimated on the basis of a noise estimate.

FIG. 13B shows an own voice beamformer illustrating how the own voice-enhancing post filter (OV-PF) gain (PF gain(k) of FIG. 13A) may be estimated on basis of a noise estimate in terms of an own voice cancelling beamformer ($C_2(k)$, defined by complex beamformer weights ($w_{ov_cncl_1}(k)$, $w_{ov_cncl_2}(k)$) and another beamformer ($C_1(k)$, defined by complex beamformer weights ($w_{ov1}(k)$, $w_{ov2}(k)$) containing the own voice signal, such as a (possibly adaptive) own voice enhancing beamformer. A direction from the user's mouth (target sound source) when the hearing device is operationally mounted is schematically indicated by arrow denoted 'Own Voice direction'.

Example of Acoustic Event Other than Own Voice: Food Intake Monitoring:

Food intake monitoring is beneficial for weight surveillance. By estimating the food intake during the day, it is possible to provide a warning if the monitored food intake is too high or too low or if the food intake should be within a certain time during the clay. Such a monitor may assist people suffering from obesity, other weight problems or diabetes. Many elderly have weight loss problems clue to too little food intake. Automatic food intake monitoring may e.g. assist caretakers that elderly have sufficient food intake. As suggested in [Liutkus et al.; 2015], food intake may be monitored by monitoring food intake acoustics, such as chewing and swallowing sounds. The problem is that foot intake acoustics are low-energy sounds, and the sounds are thus difficult to reliably detect in loud sound environments such as restaurant.

Figure 11B:
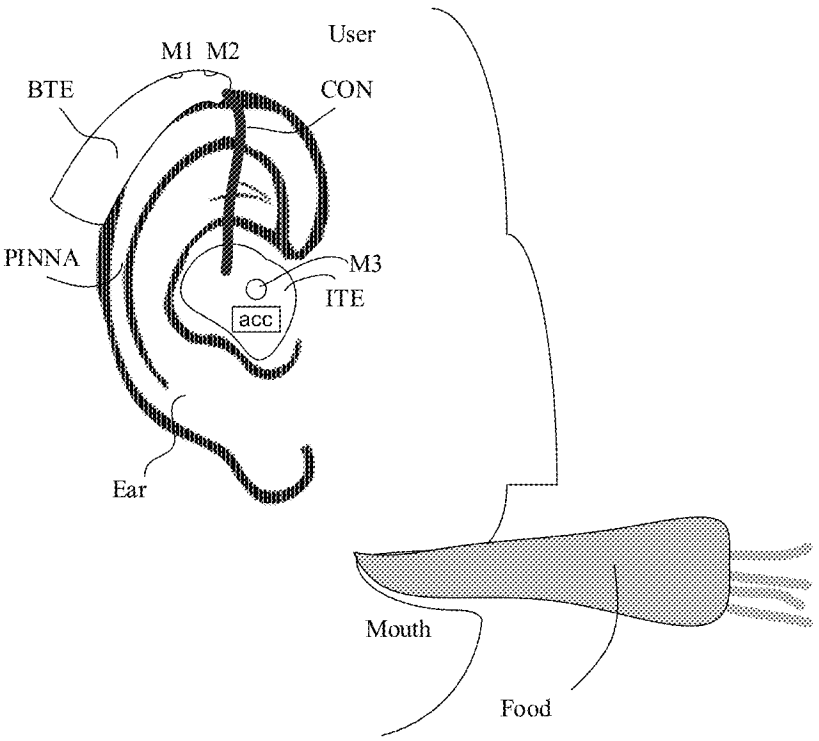
FIG. 11B illustrates possible microphone and accelerometer placements for food intake acoustics detection for an BTE+ITE-style hearing device, FIG. 12 schematically illustrates a proposed method on how the food intake sound may be detected based on correlations between different sensors.

It is proposed to monitor food intake sounds by a hearing instrument containing both at least one microphone and a movement sensor, e.g. an accelerometer. While the microphones record both food intake sounds and other acoustic events, the accelerometer is more suitable for picking up vibrations from food intake sounds independent from the sound level of the environment. Possible placements of the hearing instrument microphones and the accelerometer are shown in FIG. 11A and FIG. 11B.

Figure 11A:
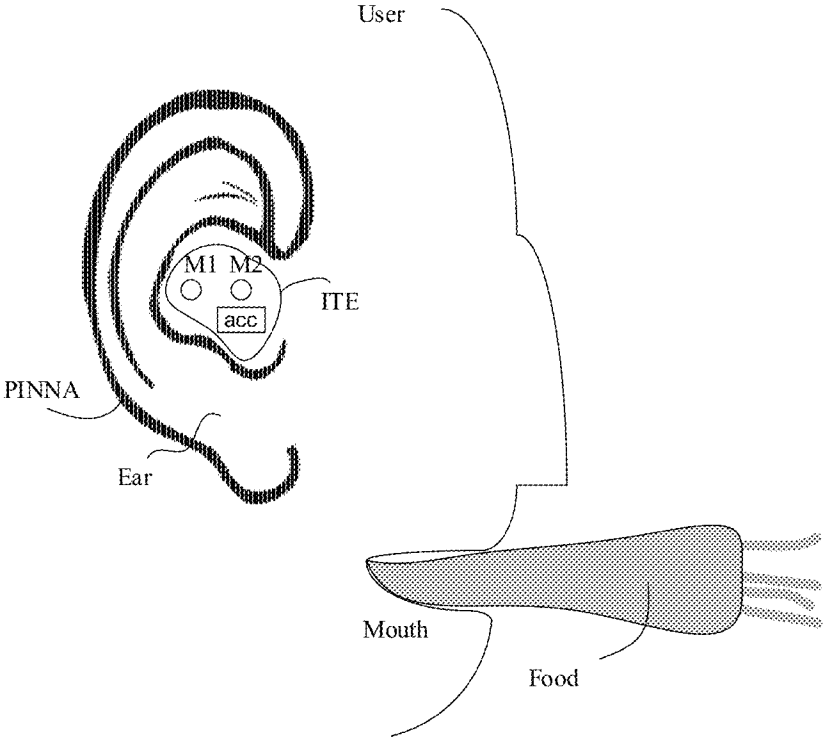
FIG. 11A illustrates possible microphone and accelerometer placements for food intake acoustics detection for an ITE-type hearing device.

FIG. 11A illustrates possible microphone and accelerometer placements for food intake acoustics detection for an ITE type hearing device. FIG. 11B illustrates possible microphone and accelerometer placements for food intake acoustics detection for a hearing device comprising a BTE-part as well as an ITE-part.

Preferably, the accelerometer (acc) is placed within an in-the-ear (ITE) unit. The ITE unit may as well contain microphones (M1, M2 in FIG. 11A, M3 in FIG. 11B). The microphones may also be placed in a behind-the-ear (BTE) unit (cf. FIG. 11B), or preferably, at least one microphone ((M1, M2) in FIG. 11B) is placed in a BTE unit and at least one microphone (M3 in FIG. 11B) is placed along with the accelerometer (acc) in the ITE unit. The ITE unit may e.g. comprise a microphone, an accelerometer, and a receiver (loudspeaker).

Preferably, the accelerometer is placed in an ITE unit, as vibrations from the jaw (during chewing of food (Food) in the user's mouth (Mouth)) easily is picked up by an accelerometer (acc) placed in the ear. Also, a microphone in the ear will more easily be able to pick up chewing sounds than a microphone behind the ear. In order to distinguish between chewing sounds and external acoustic sounds, a correlation between the ITE microphone signal and the accelerometer vibrations would indicate a food intake sound. Additional correlations between the sensors in the ear and the sensors behind the ear would further ease the distinction between internal acoustic events and external acoustic events. It would likewise ease the distinction between food intake sounds and own voice. Furthermore, own voice will typically have different acoustic properties compared to the acoustic events generated by food intake.

Figure 12:
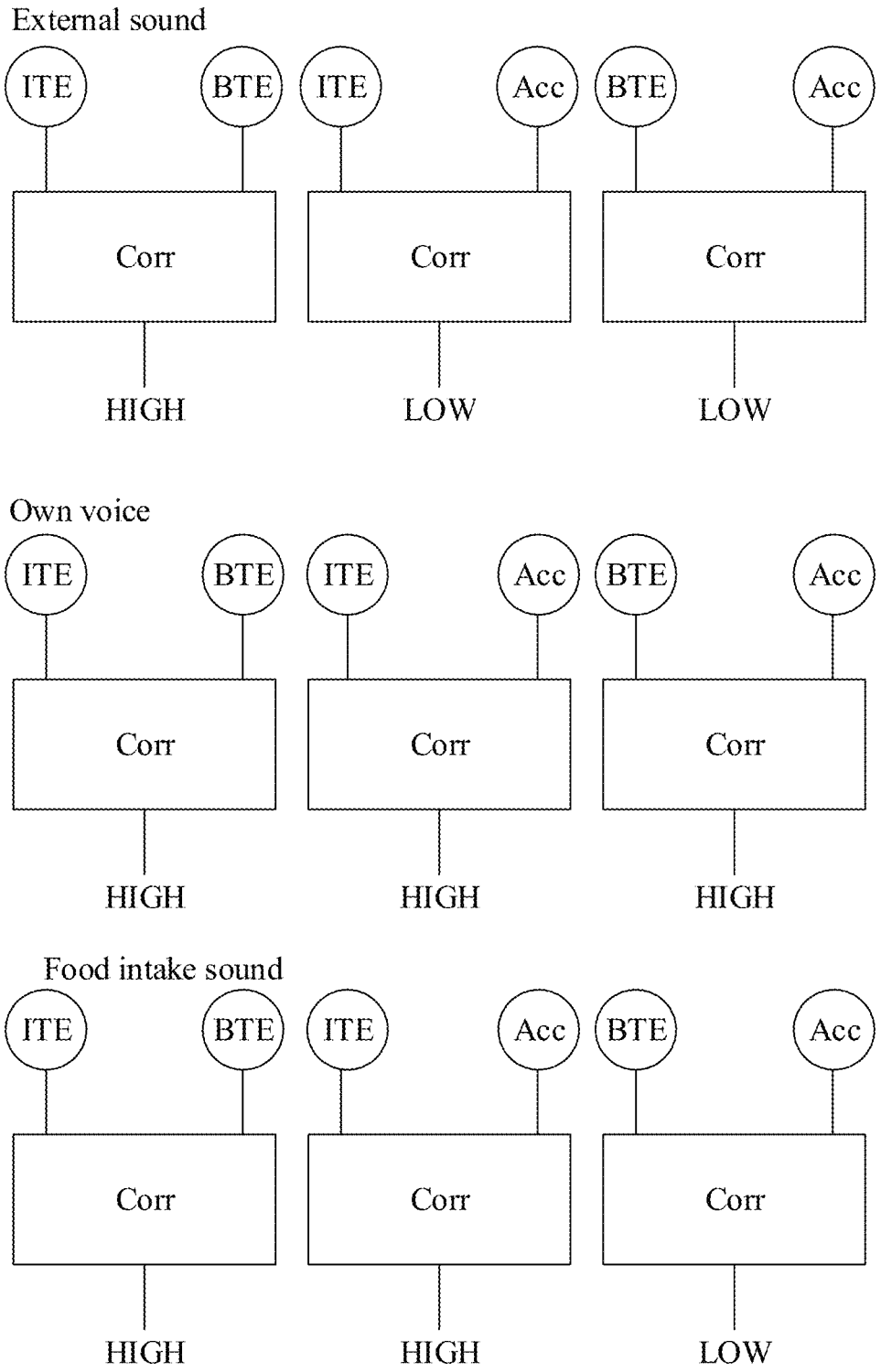

FIG. 12 schematically illustrates a proposed method on how the food intake sound may be detected based on correlations between different sensors. The detection of three different sound types 'External sound', 'Own voice' and 'Food intake sound' are dealt with in the top, medial and bottom parts, respectively, of FIG. 12. For each sound type, the expected outcome (estimated as LOW or HIGH) of three correlation measurements are indicated in FIG. 12: Left: Correlation between signals from an ITE and a BTE microphone; Middle: Correlation between signals from an ITE microphone and an accelerometer; RIGHT: Correlation between signals from a BTE microphone and an accelerometer. In addition to or in the absence of a BTE microphone, the different acoustic properties of speech and food intake sounds may be taken into account. The food intake detection may as well be based on the adaptation factor $\beta(k)$, e.g. in addition to the accelerometer data. The food intake classification/detection may as well be based on logistic regression or a neural network trained on labelled data (food intake/not food intake). Food intake detections may be logged in the hearing device or in an external device wirelessly connected to the hearing device. Based on the logged food intake events, a warning may be communicated to the user and/or caretaker, if e.g. the food intake is too low, too high, or if the food intake is not within a certain time during the day. Hereby the food intake monitoring may assist the user in maintaining a stable blood sugar level throughout the day (which is e.g. important for people with diabetes).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP3236672A1 (Oticon) 25 Oct. 2017

EP2835987A1 (Oticon) 18 Oct. 2017

[Liutkus et al.; 2015] Antoine Liutkus, Temiloluwa Olubanjo, Elliot Moore, Maysam Ghovanloo, Source separation for target enhancement of food intake acoustics from noisy recordings, 2015 IEEE Workshop on Applications of Signal Processing to Audio and Acoustics, Oct. 18-21, 2015, New Paltz, N.Y., 5 pages.

The invention claimed is:

1. A hearing device configured to be located at or in an ear, or to be fully or partially implanted in the head at an ear, of a user, the hearing device comprising:

an input unit providing a multitude of electric input signals representing sound in an environment of the user;

an output unit for providing stimuli perceivable to the user as sound based on said electric input signals or a processed version thereof;

an adaptive beamformer filtering unit connected to said input unit and to said output unit, and configured to provide a spatially filtered signal based on said multitude of electric input signals and an adaptively updated adaptation factor β(k), where k is a frequency index; and a memory, wherein A) a reference value REF, equal to or dependent on a value, $\beta_{ov}(k)$, of said adaptation factor β(k) determined when a voice of the user is present, is stored, or wherein B) a set of parameters for classification based on logistic regression or a neural network, is stored; and an own voice detector configured to provide an estimate of whether or not, or with what probability, a given input sound originates from the voice of the user, and wherein said estimate, termed the own voice indicator, is dependent on a) a current value of said adaptation factor β(k) and said reference value REF, or on b) said set of parameters for classification based on logistic regression or a neural network, respectively.

2. A hearing device according to claim 1 wherein the adaptive beamformer filtering unit comprises a first set of beamformers $C_1$ and $C_2$, wherein the adaptive beamformer filtering unit is configured to provide a resulting directional signal $Y(k)=C_1(k)-\beta(k)C_2(k)$, where β(k) is said adaptively updated adaptation factor.

3. A hearing device according to claim 2 wherein said beamformers $C_1$ and $C_2$ comprise a beamformer $C_1$ which is configured to leave a signal from a target direction un-altered, and an orthogonal beamformer $C_2$ which is configured to cancel the signal from the target direction.

4. A hearing device according to claim 2 wherein said two beamformers $C_1$ and $C_2$ comprise an orthogonal beamformer $C_1$ which is configured to cancel the signal from the target direction, and a beamformer $C_2$ which is not orthogonal to $C_1$.

5. A hearing device according to claim 2 wherein said adaptively updated adaptation factor β(k) may be expressed as $$\beta(k) = \frac{\langle C_2^* C_1 \rangle}{\langle |C_2|^2 \rangle + c}$$

where β(k) minimizes the noise under the constraint that the signal from the target direction is unaltered, where k is the frequency index, * denotes the complex conjugation, ⟨·⟩ denotes the statistical expectation operator, and c is a constant.

6. A hearing device according to claim 2 wherein said adaptively updated adaptation factor β(k) is updated by an LMS or NLMS equation:

$$\beta(n, k) = \beta(n-1, k) + \mu \frac{C_2^* Y - \alpha\beta(n-1, k)}{|C_2|^2},$$

where α is a constant, and n and k are time and frequency indices, respectively.

7. A hearing device according to claim 1 wherein said own voice indicator OV is determined by the following expression $$OV = \sum_k \omega(k) \Re(\beta(k)) > TH_{ov},$$

where ω(k) is a frequency channel weighting function, ℜ(β(k) represent the real part of said adaptation factor β(k), and $TH_{ov}$ is a threshold value.

8. A hearing device according to claim 7 wherein ω(k)=1 for lower frequency channels below a first threshold frequency, and ω(k)=0 for higher frequency channels above a second threshold frequency.

9. A hearing device according to claim 1 configured to provide that said adaptation factor β is updated in dependence of a noise flag.

10. A hearing device according to claim 1 comprising antenna and transceiver circuitry allowing the exchange of information and/or audio signals between the hearing device and another device.

11. A hearing device according to claim 10 wherein said own voice indicator is dependent of an own voice estimate provided by another device.

12. A hearing device according to claim 1 wherein said own voice indicator is dependent of one or more other detectors.

13. A hearing device according to claim 1 being constituted by or comprising a hearing aid, a headset, an earphone, an ear protection device or a combination thereof.

14. A hearing system comprising a first hearing device according to claim 1 and an auxiliary device, wherein the hearing system is adapted to establish a communication link between the hearing device and the auxiliary device to provide that information and/or audio signals can be exchanged or forwarded from one to the other.

15. A hearing system comprising a first hearing device and a second hearing device according to claim 1, said first and second hearing devices forming part of a binaural hearing system, the hearing system further comprising an auxiliary device, wherein the hearing system is adapted to establish a communication link between at least one of the hearing devices and the auxiliary device to provide that information and/or audio signals can be exchanged or forwarded from one to the other.

16. A hearing system according to claim 15 comprising a control unit configured to compare respective current values of the updated adaptation factor β(k), and wherein an indication of whether or not a telephone is held in proximity of a given ear of the user is determined based on said updated adaptation factors β(k).

17. A hearing device according to claim 1 wherein the number of electric input signals representing sound in the environment of the user is two.

18. A hearing device according to claim 1 wherein the input unit comprises two microphones.

19. A method of operating a hearing device configured to be located at or in an ear, or to be fully or partially implanted in the head at an ear, of a user, the method comprising:

providing a multitude of electric input signals representing sound in an environment of the user;

providing stimuli perceivable to the user as sound based on said electric input signals or a processed version thereof;

providing a spatially filtered signal based on said multitude of electric input signals and an adaptively updated adaptation factor β(k), where k is a frequency index;

and storing a reference value REF equal to or dependent on said adaptation factor β(k) determined when the voice of the user is present, or storing a set of parameters for classification based on logistic regression or a neural network; and providing an estimate of whether or not, or with what probability, a given input sound originates from the voice of the user, wherein said estimate is dependent on a current value of said adaptation factor β(k) and said reference value REF, or on said set of parameters for classification based on logistic regression or a neural network.

20. A method according to claim 19 wherein said set of parameters for classification are based on supervised learning.

21. A method according to claim 19 wherein inputs to the neural network are constituted by or comprises the parameter or vector β, or a subset thereof.

22. A method according to claim 21 wherein inputs to the neural network are constituted by or comprises values of β corresponding to frequencies below a threshold frequency $f_{th}$.

23. A method according to claim 21 wherein inputs to the neural network are constituted by or comprises additional features besides β selected among the features a) accelerometer data, b) a β-vector from another hearing device (β may be exchanged between the hearing devices at respective ears), c) Mel Frequency Cepstral Coefficients (MFCC), and d) features derived thereof, or combinations thereof.

24. A method according to claim 19 wherein different neural networks are trained for different applications.

* * * * *